US005815048A

United States Patent [19]

Ala-Kojola et al.

[11] Patent Number: 5,815,048

[45] Date of Patent: Sep. 29, 1998

[54] SWITCHABLE DUPLEX FILTER

[75] Inventors: Jouni Ala-Kojola; Jukka Loukkola, both of Kempele, Finland

[73] Assignee: LK-Products Oy, Kempele, Finland

[21] Appl. No.: 754,873

[22] Filed: Nov. 22, 1996

[30] Foreign Application Priority Data

Nov. 23, 1995 [FI] Finland ..... 955637

[51] Int. Cl.[6] ..... H01P 5/12; H01P 1/202

[52] U.S. Cl. ..... 333/101; 333/132; 333/134; 333/206

[58] Field of Search ..... 333/101, 132, 333/134, 174, 202, 204, 206

[56] References Cited

U.S. PATENT DOCUMENTS 5,023,935 6/1991 Vancraeynest ..... 333/134 X
5,387,886 2/1995 Takalo et al. ..... 333/134 X
5,515,017 5/1996 Yamada et al. ..... 333/134 X
5,541,560 7/1996 Turunen et al. ..... 333/207

*Primary Examiner*—Seungsook Ham
*Attorney, Agent, or Firm*—Darby & Darby

[57] ABSTRACT

A radio frequency filter has a band-pass type frequency response which is controllable in a manner such that the frequency response may be moved between the transmission frequency (TX') and reception frequency (RX') of associated radio equipment. Thus the radio frequency filter may be used both as a transmission filter and as receiving filter, provided that the transmission and reception take place at different times. The radio frequency filter includes a change-over switch, which connects the radio frequency filter to a transmitter when the pass band of the radio frequency filter is in the transmission frequency, and which connects to the receiver when the pass band of the radio frequency filter is in the reception frequency.

13 Claims, 3 Drawing Sheets

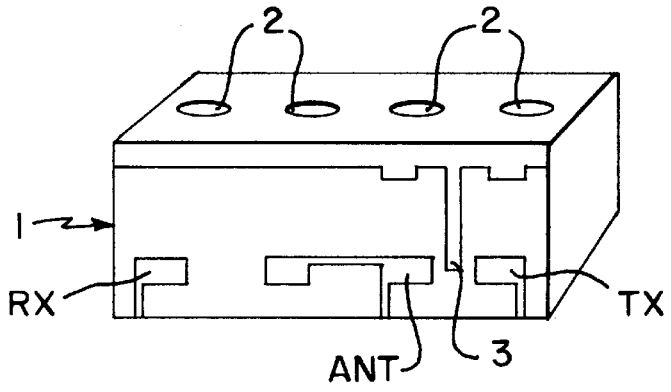
FIG. 1
PRIOR ART
FIG. 2
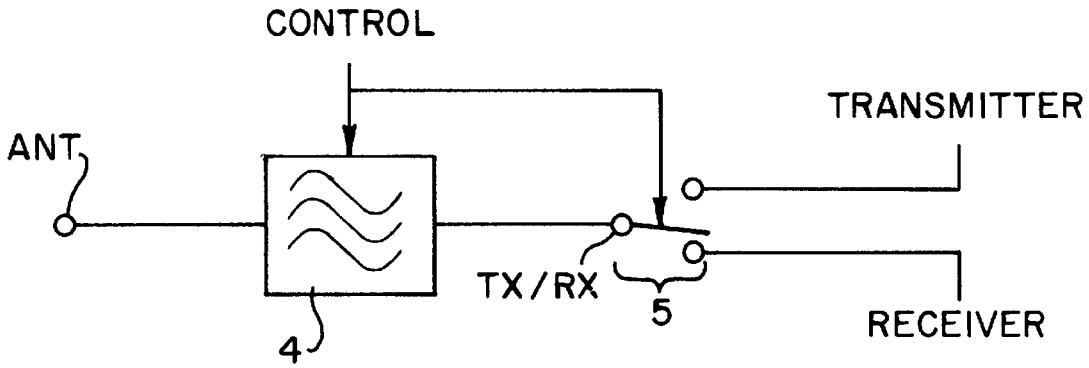
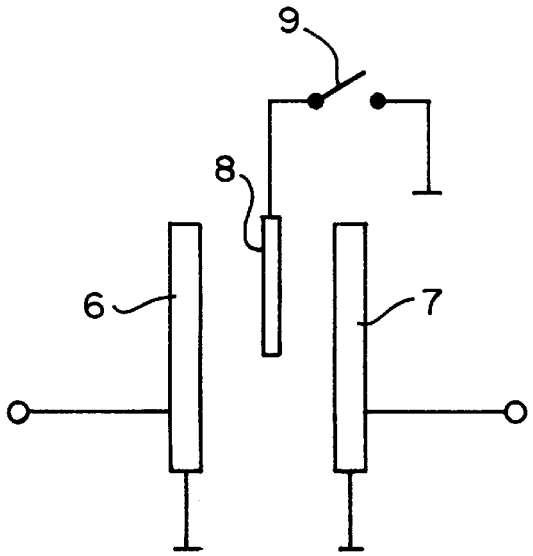
FIG. 3

SWITCHABLE DUPLEX FILTER

BACKGROUND OF THE INVENTION

1. Field of the Invention

The invention relates to frequency response control in a filter which is based on transmission line resonators. In a filter according to the invention, controlling is focused especially on the location of the pass band of a bandpass filter on the frequency axis. The invention can be applied in duplex filters, in particular.

2. Description of the Prior Art

Filters based on transmission line resonators and electromagnetic couplings between them are generally used in radio equipment. Between the transmission line resonators, which are coupled through an insulating material by means of electromagnetic fields, there generally occurs both a capacitive and an inductive coupling, which together result in a certain frequency response in the filter constituted by the resonators. Particularly said capacitive and inductive couplings together cause in the frequency response of the bandpass filter a transmission zero, or a certain narrow frequency range, which limits the pass band of the filter on one side and in which the attenuation of the filter is particularly high. In a filter which is based on so-called $\lambda/4$ resonators, i.e. in which the electric length of the resonators is essentially one fourth of the wavelength corresponding to the nominal frequency of the filter, the location of said transmission zero with respect to the pass band of the filter depends on the mutual intensities of the capacitive and inductive couplings between the resonators. If the capacitive coupling is dominant, the transmission zero is located below the pass band, and if the inductive coupling is dominant, the transmission zero is located above the pass band.

The strength of the coupling between two resonators is determined by the combined effect of the capacitive and inductive coupling between them. The phase difference between the capacitive and inductive coupling is 180 degrees, which means that they have opposite signs and therefore tend to cancel each other. This enables making both couplings sufficiently high in a bandpass filter so as to have the zero of the frequency response at a suitable distance from the pass band, while the combined effect is still sufficiently low to realize the bandpass characteristic of the filter. If the absolute values of the inductive and capacitive couplings are equal, the total coupling between the resonators is zero, in which case it is not possible to realize a bandpass filter with them.

As is previously known, it is possible to influence the strength of the inductive and capacitive coupling by selecting the dimensions of the filter structure suitably. The U.S. Pat. No. 5,239,279 (Turunen, Näppä) also presents a method in which the couplings are influenced by forming strip-like areas in the vicinity of the resonators, which areas, depending on their location and method of implementation, either strengthen or weaken the electric and/or magnetic field, which acts as a medium of coupling between the resonators. Similar means for changing the coupling are also presented in the patent specification U.S. Pat. No. 4,716,391 (Moutrie et al). Other known controlling methods are presented in the publications U.S. Pat. No. 4,410,868 (Takeshi Meguro et al) and U.S. Pat. No. 4,559,508 (Toshio Nishikawa et al).

All the prior art solutions cited above have the basic shortcoming that when the filter has been manufactured with certain dimensions and possibly fine-tuned by mechanically adjusting the strip elements that affect the coupling, its frequency response cannot be influenced during use, at least not in any simple manner. In some applications it would be desirable that the frequency response of the filter, particularly the location of the transmission zero or the frequency response zero, could be changed using an external control voltage or current.

There is also known from the Finnish patent application 953962 (LK-Products Oy, Bandpass Filter with Controllable Attenuation Properties) a resonator-based radio frequency filter, the frequency response of which can be electrically adjusted. In this application, an electrically controllable switch or an electrically adjustable reactive component has been added between the passive regulating element in the vicinity of the resonators and the ground potential of the filter. The switch or adjustable reactive component serves to change the reactance between the regulating element and the ground level of the filter.

Using bandpass filters it is possible to implement a duplex filter, which as a generic term refers to a filter that separates the transmitted signal and received signal from each other in radio equipment where transmission and reception take place via the same antenna at different frequencies. The prior art duplex filter is a three-port circuit device, which comprises a transmitter port, a receiver port and an antenna port. A radio signal brought to the transmitter port at a certain transmission frequency sees the signal path leading to the receiver port as a high impedance, in which case the radio power of transmission frequency is not directed in any substantial amount to the receiver port, but it is directed through the antenna port to the antenna, from which it is radiated as a radio signal to the environment. Similarly, the radio signal of the reception frequency which comes via the antenna and antenna port sees the direction of the transmitter port as a high impedance, whereby it is directed to the receiver port and through it to the receiver parts of the radio equipment. The difference between the transmission and reception frequencies is called a duplex interval.

In modern radio communication devices, such as mobile phones, the size of filters is a very critical factor. In a prior art duplex filter, which comprises transmission line resonators, a certain number of resonators are needed in the transmission branch (between the transmitter port and the antenna port) and similarly, a certain number of resonators are needed in the receiving branch (between the antenna port and the receiver port). The number of resonators depends, among other factors, on the stop attenuation required, that is, how precisely the transmission frequency signal must be prevented from entering the receiving branch. When the size of mobile communication devices is further reduced, a problem to be encountered is how the size of the filter can be decreased without making compromises in the performance.

FIG. 1 shows a prior art ceramic duplex filter, the frame block 1 of which is manufactured from dielectric ceramic material. In it there have been formed four resonator holes 2, the inner surfaces of which are coated with electrically conductive material, preferably a metal coating. On the visible side of the frame block there are formed switching patterns of electrically conductive material, which patterns comprise a transmitter port TX, an antenna port ANT and a receiving port RX. In the Figure, the darkened surface areas of block 1 depict uncoated portions and the white areas correspond to the electrically conductive coating. At the two rightmost resonators there is formed a strip conductor pattern 3, which influences—in a manner known from previously mentioned patent specifications—on the electromagnetic coupling between the resonators and thereby on the frequency response of the transmission filter formed by the resonators.

SUMMARY OF THE INVENTION

An object of this invention is to provide a radio frequency filter, which operates as a duplex filter and has very small physical dimensions. Another object of the invention is to provide a radio frequency filter, which enables changing the location of its pass band on the frequency axis electrically. A further object of the invention is to present a duplex filter which has only two signal ports. A still further object of the invention is to present a radio frequency filter, in which the transmission line resonators are used for implementing two different band-pass functions depending on the control signal.

A radio frequency filter according to the invention, which comprises a first port for coupling to the antenna and a second port for coupling to radio equipment and first switching means for changing the potential of the filter regulating element, is characterized in that it comprises second switching means between said second port and the transmission part and reception part of said radio equipment, and that said second switching means are arranged so as to connect said second port alternatively to the radio equipment's transmitter part or receiver part, thus operating in synchronization with said first switching means.

The invention also relates to a method for using the same filter as the transmission and reception filter of radio equipment, which filter comprises transmission line resonators. The method according to the invention is characterized in that the electromagnetic coupling between said transmission line resonators is changed by changing the potential of the electrically conductive element in their vicinity, and the filter is switched alternately to the transmitter and receiver of the radio equipment in synchronization with the changing of said potential.

The invention is based on the idea that the pass band and the respective limiting transmission zero of a resonator-based radio frequency filter can be moved with the electric control signal so that a filter constituted by the same resonators can operate, depending on the control signal, either as a transmission or reception filter in radio equipment in which transmission and reception take place on different frequency bands. The control signal is set to influence the potential of a certain regulating element located in the vicinity of the resonators. With a certain first value thereof, the pass band of the filter covers the transmission frequency band and the transmission zero is in the reception frequency, whereby the transmission frequency signal gets through the filter but the reception frequencies are filtered away. With a certain second value of the control signal and similarly the potential of the regulating element, the pass band of the filter is in the reception frequency and the transmission zero is in the transmission frequency, whereby only the reception frequency signal gets through the filter. Because the same resonators are used to implement both the transmission and reception filter, the total number of transmission line resonators needed in the radio equipment is smaller than in the prior art solutions.

The filter according to the invention is a duplex filter, which has only two ports. The first port is an antenna port, which is continuously coupled to the antenna of the radio equipment. The second port is switched by a separate switching means alternately to the transmitter or receiver of the radio equipment, depending on whether the filter is set by the control signal to operate as a transmission filter or a reception filter. The control of the switching means and the control signal that affects the properties of the filter operate in synchronization. The switching means corresponds to the antenna switch which is known as such, and it can be any electrically controlled switch, known to a person skilled in the art, preferably a PIN diode or a combination thereof, a field-effect transistor (FET) or other voltage and/or current controlled semiconductor switch. The potential of the regulating element is also changed, preferably by a semiconductor switch connected to it. If the semiconductor switches are made of gallium arsenide (GaAs), for example, they can be made fast and reliable, and thus it is possible to change the frequency response of the filter very fast between two different states.

The regulating element, by which a filter according to the invention is changed from a transmission filter to a reception filter and vice versa by changing the potential thereof, is constituted by a certain electrically conductive device, which is located in the vicinity of the resonators and affects the electromagnetic coupling between them. If the filter according to the invention comprises dielectric resonators formed in a ceramic block, the electrically conductive device is preferably a strip conductor formed on the surface of the ceramic frame block. If the filter is implemented by helix resonator technology, the corresponding electrically conductive device is preferably formed as a strip conductor on the surface of a low loss circuit board which operates as the support structure of a helix resonator.

The capacitive coupling between the transmission line resonators is strongest at their (electrically) open, ungrounded end. The inductive coupling is strongest at the grounded end of the resonators. The regulating element is preferably formed near the open end of the resonators, whereby it, ungrounded, strengthens the capacitive coupling. The grounding of the element weakens the capacitive coupling, whereby the inductive coupling becomes dominant in the combined effect of the couplings. An electrically controllable switch connected between the regulating element and the ground potential is used for the grounding.

In the following, the invention will be described in more detail using the preferred embodiments as examples and with reference to the appended drawings, in which

BRIEF DESCRIPTION OF THE DRAWINGS

FIG. 1 shows a prior art ceramic duplex filter,

FIG. 2 shows a diagram of the principle of the invention,

FIG. 3 shows a circuit diagram of one embodiment for implementing the principle of the invention.

DESCRIPTION OF THE PREFERRED EMBODIMENT(S)

Figure 4:
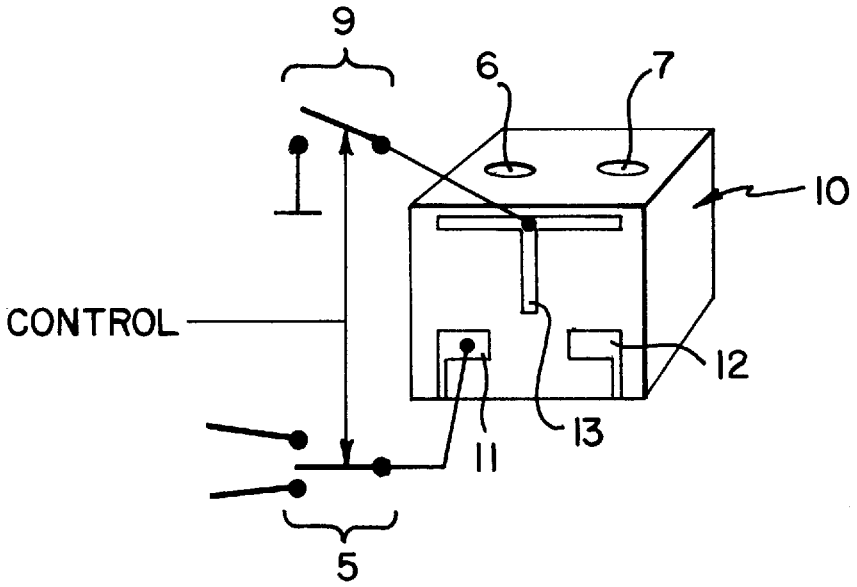
FIG. 4 shows one preferred embodiment of the invention.

In accordance with the principle shown in FIG. 2, the filter 4 according to the invention comprises an antenna port ANT and a radio equipment port TX/RX. In addition, it comprises a control signal input CONTROL, whereby it depends on the control signal brought to it whether the filter 4 operates as a transmission or reception filter. The duplex filter arrangement according to the invention also includes a switch 5, which switches the radio equipment port TX/RX of the filter to the transmitter or receiver of the radio equipment in synchronization with the control signal CONTROL.

FIG. 3 shows a circuit diagram, in which there is between two transmission line resonators 6, 7 an electrically conductive regulating element 8, which influences the coupling between the resonators 6 and 7. The regulating element 8 can be grounded with switch 9, if desired. When switch 9 is closed, the regulating element 8 in the vicinity of the open end of resonators 6 and 7 is essentially at ground potential, whereby it weakens the capacitive coupling between the resonators. Thus the electromagnetic coupling between the resonators is dominantly inductive, and so the frequency response formed by the resonators has the transmission zero above the pass band. If the transmission frequency of the radio equipment is lower than its receiving frequency, the filter is a transmission filter. When switch 9 is opened, the regulating element 8 has a floating potential, whereby it strengthens the capacitive coupling between the resonators 6 and 7, and as a combined effect, the coupling of the resonators is dominantly capacitive. The transmission zero of the frequency response moves below the pass band, and the pass band moves upwards by a duplex interval, whereby the same filter operates as a reception filter. In the following, the technical implementation of this embodiment will be described in more detail.

FIG. 4 shows a dielectric filter made of one piece (a so-called monoblock), which includes two transmission line resonators 6 and 7. The manufacture of filters like this is a technique known to a person skilled in the art, and it will not be dealt with here. The dielectric block 10, which constitutes the body of the filter, is preferably of ceramic material, and the resonators 6 and 7 are cylindrical holes in the block, extending from the lower surface of block 10 to its upper surface (the top surface in the figure) of the block. The cylindrical surfaces that define the holes have a conductive coating. The resonator holes can also be physically closed at the ungrounded end. Most of the side surfaces of the block 10 are also coated with a conductive material, which is shown by white colour in the figure. The front side shown in FIG. 4 is not entirely coated, but strip-like conductive patterns 11, 12 and 13 have been formed on it. The top side shown in FIG. 4 is uncoated. The uncoated ceramic material is shown as grey in the Figure. The two widest conductive patterns 11 and 12 constitute the input and output ports of the filter, i.e. they provide the coupling interface to the resonators 6 and 7. The third conductor pattern 13 is a regulating element, which strengthens the capacitive coupling between the resonators 6 and 7 in a known manner, when ungrounded.

Figure 5:
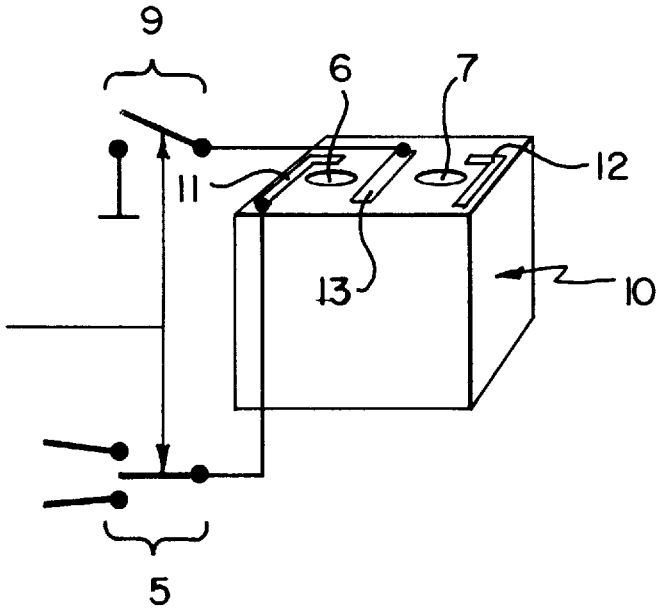
FIG. 5 shows another preferred embodiment of the invention.

The alternative embodiment shown in FIG. 5 is also a dielectric filter, which differs from the embodiment of FIG. 4 only in that here also the front side is coated with a conductive layer, and the conductive patterns 11, 12 and 13 are formed on the top surface, which is uncoated except for said conductive patterns.

In accordance with the invention, the embodiments shown in FIGS. 3, 4 and 5 comprise a switch 9, which is shown in the figures as a general outline only. A person skilled in the art is readily capable of realizing such a switch with a PIN diode, a field-effect transistor or other semiconductor switch known as such. In the implementation, the switch component in question is connected by soldering, for example, to connection pads (not shown in the figures), which are formed on the surface of the dielectric block 10 in the same manner as the other conductive patterns 11, 12 and 13. Also the control signal CONTROL, which opens and closes the switch 9, is coupled to said switch component using strip lines (not shown in the figures) formed on the surface of the dielectric block.

Figure 6:
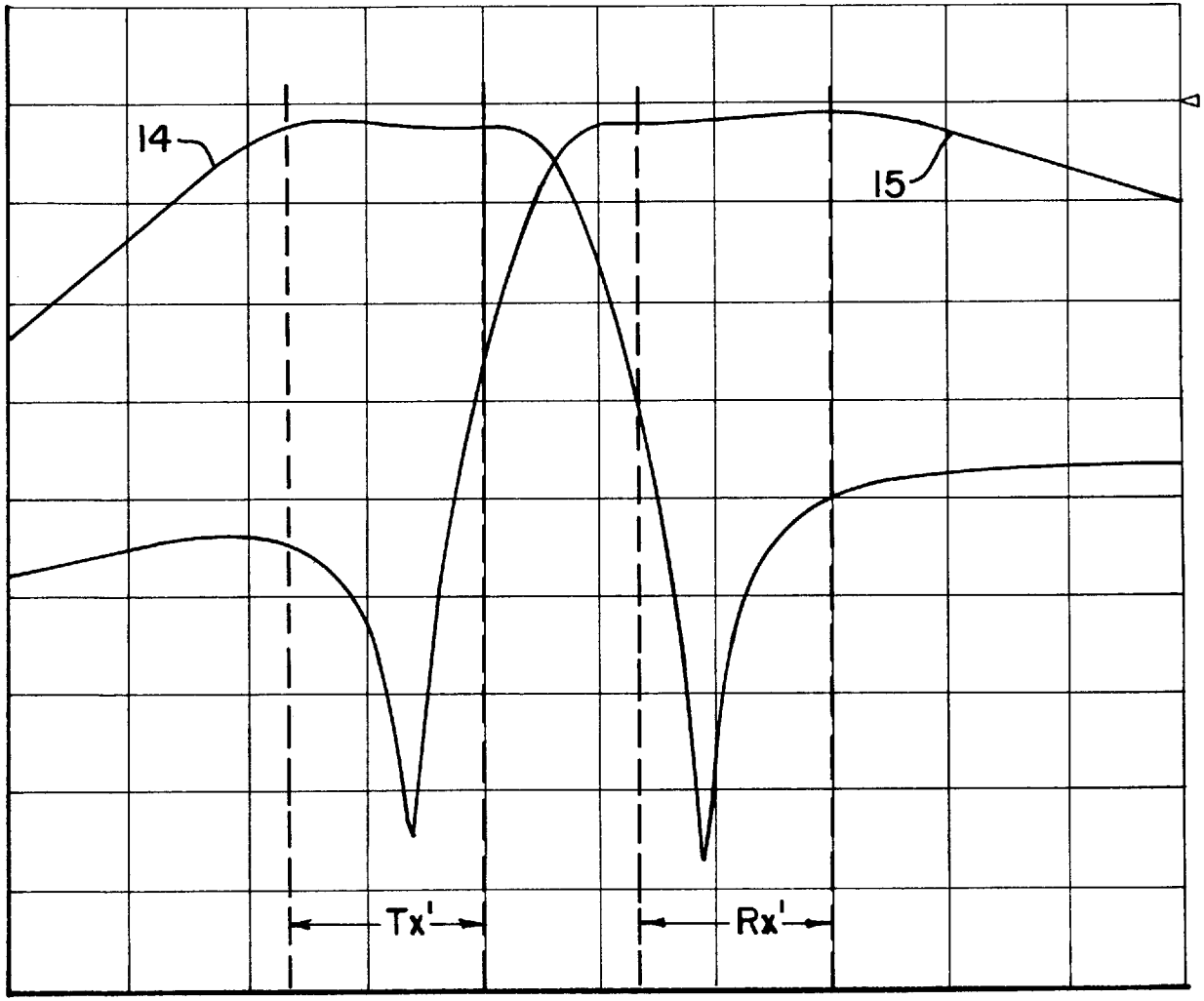
FIG. 6 is a qualitative diagram of the frequency response properties that can be achieved by the embodiments of the invention according to FIGS. 4 and 5.

The switch 9 is open in the position shown in the FIGS. 3, 4 and 5, whereby it does not substantially influence the operation of the filter. When the switch 9 is closed, it couples the regulating element 13 to ground potential, whereby the grounded regulating element 13 weakens the capacitive coupling between the resonators 6 and 7. In accordance with the principle presented above in connection with the description of the prior art, the weakening of the capacitive coupling strengthens the relative portion of the inductive coupling, which in turn moves the transmission zero of the frequency response of the filter upwards on the frequency axis. FIG. 6 shows a qualitative presentation of a real frequency response measurement, in which the frequency response of a filter according to the embodiment shown in FIG. 3 is measured while the switch 9 is closed (curve 14) and open (curve 15). FIG. 6 shows that closing the switch 9 (grounding the regulating element 13) turns the frequency response almost into a mirror image in relation to an assumed axis, which is located half-way between the transmission band TX' and the reception band RX'. In a transmission situation depicted by the curve 14, the filter causes only a weak attenuation on the transmission band TX', but a strong attenuation on the frequencies of the reception band RX'. In the situation of curve 15, the pass band and the stop band have changed places.

The switch shown schematically in FIGS. 3, 4 and 5, the purpose of which is to switch the radio equipment port 11 of the filter alternately to the transmitter and receiver of the radio equipment, corresponds in its component arrangement to the switch 9, and it can be connected to connection pads on the surface of the dielectric block 10, or it can be situated on the surface of a substrate plate which is part of the filter, or on the surface of a circuit board (not shown in the figures) of the radio equipment. A control signal is brought to it, which signal is the same or in the same phase as the signal brought to switch 9. With the first value of the control signal CONTROL, the switch 5 switches the radio equipment port 11 of the filter to the transmitter (not shown in the figure) of the radio equipment, whereby the switch 9 is also closed and the pass band of the filter is located in the transmission frequency. With the second value of the control signal, the switch 5 switches the radio equipment port 11 of the filter to the receiver (not shown in the figure) of the radio equipment. Then the switch 9 is open and the filter passes the reception frequency and filters the transmission and other undesired frequencies.

In a filter according to the invention, the frequency response of a two-port filter which preferably comprises only two resonators can be set alternately to correspond to the transmission and reception branch of an ordinary duplex filter. The change of the frequency response takes place fast and easily. A very small duplex filter can be achieved by providing the filter with a change-over switch.

The invention is not limited to dielectric filters only, but it can be applied to all filter constructions which are based on transmission line resonators and in which the coupling between the resonators can be influenced by a conductive regulating element. Another possible exemplary filter construction is a helix filter based on cylindrical coil conductors, the like of which is known, for example, from the Finnish patent specification FI-90157, wherein the regulating elements according to the invention can be manufactured as strip lines in a similar manner as in the embodiments described above. Filters according to the invention can be advantageously used in small radio communication devices, such as mobile phones.

What is claimed is:

1. A radio frequency filter, which comprises:

a first transmission line resonator (6) and a second transmission line resonator (7), arranged to have an electromagnetic coupling therebetween, a first port (ANT, 12) for conducting a signal between the radio frequency filter and an antenna, a second port (TX/RX, 11) for conducting a signal between the radio frequency filter and other parts of a radio equipment, a regulating element (8, 13) having a single strip conductive pattern (13) extending in length substantially between the transmission line resonators (6, 7) for affecting the electromagnetic coupling, first switching means (9) between the regulating element (8, 13) and a ground potential for changing the potential of the regulating element to connect or to disconnect the single strip conductive pattern (13) to the ground potential or from the ground potential, respectively, wherein the transmission line resonators (6, 7) operate to perform passband functions in every configuration of the first switching means in connecting or disconnecting the single strip conductive pattern (13) to the ground potential or from the ground potential, respectively, second switching means having a single switch (5) between the second port (TX/RX, 11) and the transmission and reception part of said radio equipment wherein the single switch (5) is arranged so as to switch the second port (TX/RX, 11) alternatively to said transmitter part or reception part, with the single switch (5) operating in synchronization with said first switching means (9).

2. A radio frequency filter according to claim 1, wherein the regulating element affects the electromagnetic coupling of the transmission line resonators (6, 7) by strengthening a capacitive coupling thereof and weakening an inductive coupling thereof when the single strip conductive pattern (13) is ungrounded, and by weakening the capacitive coupling thereof and strengthening the inductive coupling thereof when the single strip conductive pattern (13) is grounded.

3. A radio frequency filter according to claim 1, wherein the first switching means (9) switches the regulating element (8, 13) to the ground potential in response to a predetermined control signal (CONTROL).

4. A radio frequency filter according to claim 1, further comprising:

a dielectric frame block (10);

wherein the transmission line resonators (6, 7) are dielectric resonators formed in the dielectric frame block.

5. A radio frequency filter according to claim 4, wherein a first surface of the dielectric frame block (10) has switching patterns (11, 12, 13), which include said regulating element (13) and connection pads for providing a connection to the first switching means (9).

6. A method for using a radio frequency filter as a transmission and reception filter of a radio equipment, the method comprising the steps of:

electromagnetically coupling transmission line resonators (6, 7) using a single strip conductive pattern (13) extending in length substantially between the transmission line resonators (6, 7) for affecting the electromagnetic coupling of the transmission line resonators (6, 7), switching between the regulating element (8, 13) and a ground potential for changing the potential of the regulating element to connect or to disconnect the single strip conductive pattern (13) to the ground potential or from the ground potential, respectively, including the step of:

operating the transmission line resonators (6, 7) to perform passband functions in every configuration of the first switching means in connecting or disconnecting the single strip conductive pattern (13) to the ground potential or from the ground potential, respectively, changing the electromagnetic coupling between the transmission line resonators by changing the potential of an electrically conductive element (8, 13) situated substantially adjacent to the resonators, and alternately coupling the filter to the transmitter and receiver of the radio equipment by switching a single transmitter/receiver switch (5) connected to a port (11) in synchronization with the step of changing the electromagnetic coupling for changing the potential.

7. A radio frequency filter according to claim 1, wherein the transmission line resonators (6, 7) operate to perform the passband functions with an associated passband; and wherein the regulating element (8), responsive to the switching of the first switching means (9), shifts the passband by a predetermined frequency interval to select the operation of the transmission line resonators (6, 7) for transmission functions or for reception functions, respectively.

8. A radio frequency filter according to claim 7, wherein, for a transmission frequency lower than a reception frequency, the closing of the first switching means (9) grounds the regulating element (13), thereby shifting a transmission zero associated with a frequency response of the transmission line resonators (6, 7) to be above the passband for performing transmission functions.

9. A radio frequency filter comprising:

a first transmission line resonator and a second transmission line resonator, arranged to have an electromagnetic coupling therebetween;

a first port for conducting a signal between the radio frequency filter and an antenna;

a second port for conducting a signal between the radio frequency filter and other parts of a radio equipment;

a regulating element having a single strip conductive pattern extending in length substantially between the transmission line resonators for affecting the electromagnetic coupling of the transmission line resonators by strengthening a capacitive coupling thereof and weakening an inductive coupling thereof when the single strip conductive pattern is ungrounded, and by weakening the capacitive coupling thereof and strengthening the inductive coupling thereof when the single strip conductive pattern is grounded;

a first switch disposed between the regulating element and a ground potential for changing the potential of the regulating element to connect or to disconnect the single strip conductive pattern to the ground potential or from the ground potential, respectively; and a single second switch disposed between the second port and the transmission and reception parts of the radio equipment wherein the single second switch is arranged so as to switch the second port alternatively to the transmitter part or reception part, with the single switch operating in synchronization with the first switch.

10. The radio frequency filter according to claim 9, wherein the transmission line resonators operate to perform passband functions in every configuration of the first switch in connecting or disconnecting the single strip conductive pattern to the ground potential or from the ground potential, respectively.

11. The radio frequency filter according to claim 9, wherein the first switch switches the regulating element to the ground potential in response to a predetermined control signal.

12. The radio frequency filter according to claim 9, further comprising;

a dielectric frame block;

wherein the transmission line resonators are dielectric resonators formed in the dielectric frame block.

13. The radio frequency filter according to claim 12, wherein a first surface of the dielectric frame block has switching patterns which include the regulating element and connection pads for providing a connection to the first switch.

* * * * *